US007982142B2

(12) United States Patent
Jonsson et al.

(10) Patent No.: US 7,982,142 B2
(45) Date of Patent: Jul. 19, 2011

(54) DIVERTER SWITCH, A METHOD FOR OPERATING SUCH A SWITCH AND USE OF SUCH A SWITCH

(75) Inventors: Lars Jonsson, Västerås (SE); Tommy Larsson, Ludvika (SE); Petter Nilsson, Ludvika (SE); Stefan Valdemarsson, Lidköping (SE)

(73) Assignee: ABB Research Ltd., Zürich (CH)

( * ) Notice: Subject to any disclaimer, the term of this patent is extended or adjusted under 35 U.S.C. 154(b) by 860 days.

(21) Appl. No.: 11/630,768

(22) PCT Filed: Jun. 29, 2005

(86) PCT No.: PCT/SE2005/001068

§ 371 (c)(1),
(2), (4) Date: Jan. 11, 2008

(87) PCT Pub. No.: WO2006/004527

PCT Pub. Date: Jan. 12, 2006

(65) Prior Publication Data

US 2008/0257703 A1 Oct. 23, 2008

(30) Foreign Application Priority Data

Jun. 30, 2004 (SE) ..... 0401713
Mar. 17, 2005 (SE) ..... 0500639

(51) Int. Cl.
*H01H 19/00* (2006.01)
*H01H 21/00* (2006.01)

(52) U.S. Cl. ..... 200/11 TC

(58) Field of Classification Search ..... 200/50.33, 200/11 TC, 564, 336, 252, 253, 568, 570, 200/571

See application file for complete search history.

(56) References Cited

U.S. PATENT DOCUMENTS 1,497,854 A 6/1924 Hulbert
4,978,895 A 12/1990 Schwarz
5,523,674 A * 6/1996 Dohnal et al. ..... 323/340
5,693,922 A * 12/1997 Tuohy et al. ..... 200/17 R
5,786,552 A 7/1998 Dohnal et al.
5,834,717 A * 11/1998 Neumeyer et al. ..... 200/17 R
6,492,608 B1 * 12/2002 Sun ..... 200/574

(Continued)

FOREIGN PATENT DOCUMENTS

CA 2311781 A1 11/1999

(Continued)

OTHER PUBLICATIONS

PCT/ISA/210-International Search Report, Sep. 27, 2005.

*Primary Examiner* — Renee Luebke
*Assistant Examiner* — Lheiren Mae A Caroc
(74) *Attorney, Agent, or Firm* — Venable LLP; Eric J. Franklin

(57) ABSTRACT

A diverter switch with an operating member and an electric circuit. The electric circuit has a main branch and a resistance branch connected in parallel with the main branch. Each branch includes a contact and a vacuum switch. The resistance branch also includes a resistance. The main rotary selector contact is always operated before the resistance contact. The operating member is arranged, during operation, always to rotate the main contact in one and the same direction of rotation. Also a corresponding method for operating a diverter switch and use of such a switch.

26 Claims, 7 Drawing Sheets

U.S. PATENT DOCUMENTS

| | | | | |
|---|---|---|---|---|
| 6,740,831 | B2 | 5/2004 | Baertl et al. | |
| 7,053,320 | B2 * | 5/2006 | Kodo et al. | 200/17 R |

FOREIGN PATENT DOCUMENTS

| | | | |
|---|---|---|---|
| DE | 4315060 | A1 | 11/1994 |
| DE | 19501529 | C1 | 6/1996 |
| DE | 29622685 | U1 | 10/1997 |
| EP | 0712140 | A2 | 5/1996 |
| EP | 1197977 | A2 | 4/2002 |
| GB | 2000911 | A | 1/1979 |
| WO | WO 94/02955 | A1 | 2/1994 |
| WO | WO 99/60588 | A1 | 11/1999 |
| WO | WO 00/24013 | A1 | 4/2000 |
| WO | WO 02/31846 | A1 | 4/2002 |

* cited by examiner

DIVERTER SWITCH, A METHOD FOR OPERATING SUCH A SWITCH AND USE OF SUCH A SWITCH

CROSS-REFERENCE TO RELATED APPLICATIONS

This application claims priority under 35 U.S.C. §119 to Swedish patent applications 0401713-3 filed 30 Jun. 2004 and 0500639-0 filed 17 Mar. 2005 and is the national phase under 35 U.S.C. §371 of PCT/SE2005/001068 filed 29 Jun. 2005.

TECHNICAL FIELD

The present invention relates, from a first aspect, to a diverter switch comprising an operating member and an electric switch with a main branch and a resistance branch, said main branch comprising a main contact and a main vacuum switch, said resistance branch comprising a resistance contact, a resistance vacuum switch and a resistance, said operating member being adapted, during operation, to first operate the main contact and thereafter the resistance contact.

From a second aspect, the invention relates to a method for operating such a diverter switch, and from a third aspect it relates to a use of such a diverter switch.

BACKGROUND ART

A diverter switch included in a tap changer is usually used in connection with a transformer to enable tapping at different voltage levels. This occurs in cooperation with a selector connected to the diverter switch. When the power output from a transformer is to be changed from one voltage level to another, this occurs by first connecting the selector to that tapping point of the transformer winding which corresponds to the new voltage level while the diverter switch is still feeding from the existing voltage level. The connection of the selector thus takes place without current load. When the selector is connected to the tap for the new voltage level, a switching operation then takes with the aid of the diverter switch such that output current is taken out from the new tapping point of the transformer. When a transformer has a plurality of tapping points, switching normally only occurs between two tapping points which are close to each other in terms of voltage. If an adjustment to a more distant location should be required, this takes place step by step. A diverter switch of the kind referred to here is normally used for control of power or distribution transformers. The invention is not, of course, limited to this type of application but may also advantageously be used for control of other types of power transmission or distribution products, such as reactors, phase shifters, capacitors or the like.

The operation of the diverter switch involves commutation from one circuit to another with en ensuing occurrence of an electric arc. To avoid polluting the insulating medium, such as oil, into which the diverter switch is normally immersed, and to reduce the wear of the switch contacts, it is previously known to use vacuum switches for those switching operations where an arc arises. The electrical contact wear will then only arise in the vacuum switch. For an appropriate procedure from an electrical point of view, a diverter switch of this kind is provided with at least one main branch and one resistance branch.

A diverter switch of the above kind is previously known from, for example, U.S. Pat. No. 5,786,552. The diverter switch described therein thus has one main branch and one resistance branch, in the steady state connected in parallel and connected to an output line. Each branch is provided with a vacuum switch and a contact connected in series therewith. These are operated in a definite sequence when diverter switching is to take place, in which case it is important to ensure that the main branch is operated before the resistance branch. In this way, the vacuum switch of the main branch may be dimensioned for breaking of the load current only and the vacuum switch of the resistance branch for the circulating current that arises. In case of the reverse sequence, the vacuum switch of the main branch would be forced to break the sum of these currents and thus be dimensioned therefor. Each contact is operated in different directions in a reciprocating movement to bring about an operating sequence where the main contact is operated before the resistance contact. For this reason, the contact system requires special arrangements, which implies a complex mechanical solution to the diverter switch, which thus renders difficult an efficient adaptation of the production because of the relatively complicated installation of the diverter switch. In addition, this solution to diverter switches is relatively space-demanding.

Additional examples of similar devices are described, for example, in WO94/02955, WO99/60588, WO00/24013, WO02/31846, EP 712140, EP 650637, EP 1197977, GB 2000911, U.S. Pat. No. 4,978,815, DE 29622685 and DE 4315060.

The object of the present invention is to provide a diverter switch and a method for operating such a switch, wherein said disadvantages of the prior art are eliminated, and thus achieve an operation wherein it is ensured in a simple manner that the main contact is always operated before the resistance contact.

The components for a diverter switch of this kind are dimensioned, inter alia, for transmitting a highest load current in continuous operation. However, it may be desired to utilize these components also for a higher load current. One known way to achieve this is to provide a diverter switch with a bypass function, which implies that the load current is substantially passed via a bypass connection during continuous operation. One advantage is that the load current may be increased since vacuum switches and contacts are loaded substantially only instantaneously during the switching operation. A side effect is that a bypass makes possible reduction of the losses in a diverter switch. Further, the losses in the diverter switch may then be reduced. A disadvantage of known bypass functions of this kind is that the diverter switch must be provided with complicated and expensive means for operation of the additional components.

Further objects of the present invention are therefore to provide a diverter switch with a bypass function and a method for operating such a switch, still achieving a fast, simple and reliable operation of the bypass function.

SUMMARY OF THE INVENTION

In accordance with a first aspect of the invention, the object set is achieved in that a diverter switch exhibits the special features that the operating member is arranged, during operation, always to rotate the main contact in one and the same direction of rotation.

Because the movement pattern for the main contact is considerably simplified by the unidirectional movement, the disadvantages associated with the prior art are eliminated. In addition, the main contact may be designed in a very simple manner and with increased functional safety because the rotary motion is at all times directed in the same direction.

Further, it will then be easier to mechanically fulfil the condition that the main contact should always be operated before the resistance contact.

According to a preferred embodiment, the operating member is arranged to rotate also the resistance contact in one and the same direction of rotation. The above-mentioned advantages with the unidirectional direction of rotation of the main contact are thus also obtained as regards the resistance contact.

According to another preferred embodiment, the main contact and the resistance contact are arranged to be rotated in the same direction. This implies that the required movement transfer members may be designed in a simple manner.

According to an alternative preferred embodiment in relation to the immediately preceding one, the main contact and the resistance contact are arranged to be rotated in opposite directions. In certain embodiments of the necessary movement transfer members or orientation of the contacts, this alternative embodiment may involve the simplest solution.

According to a further preferred embodiment of the invented diverter switch, the operating member comprises an operating shaft, a first movement transfer member for transmitting rotary motion of the operating shaft to a rotary shaft of the main contact, and a second movement transfer member for transmitting rotary motion of the operating shaft to a rotary shaft of the resistance contact.

In this way, the contacts will be operated individually, which facilitates achieving small dimensions and low operating energy by the fact that the contacts may have shorter sliding distances and lower friction losses while maintaining their self-cleaning function. One consequence of this is also that pollution of the oil by means of wear particles may be kept low.

According to a further preferred embodiment, said first and second movement transfer members are arranged in such a way that rotation of the resistance contact occurs when the operating shaft has been rotated through a predetermined angle from the position when rotation of the main contact has started.

This permits a simple way of synchronizing the movement of the two rotary selector contacts in relation to one another and thus achieving a predetermined time lag as far as the resistance contact is concerned.

According to still another preferred embodiment, at least one of said first and second movement transfer members comprises a Geneva mechanism.

This is a mechanism especially suited for its purpose since it permits, by simple means, transformation of rotary motion into intermittent rotary motion, where the driven part of the mechanism after a rotary motion may be easily caused to assume a position where it is ready to be driven in a new similar movement. In addition thereto, the Geneva mechanism exhibits an inherent mechanical locking function. In addition, using a Geneva mechanism in a four-part design results in a rotary motion of 90°, which is appropriate in this context. Both movement transfer members are suitably designed as Geneva mechanisms.

According to an additional preferred embodiment, the operating member is arranged to operate also the vacuum switch of the main branch and the vacuum switch of the resistance branch.

This results in the advantage that the whole switching procedure is initiated via one common operating member, which provides increased controllability and monitoring of the procedure.

According to yet another preferred embodiment, the operating member comprises a third movement transfer member for transforming rotary motion of the operating shaft into operating motion for the vacuum switch of the main branch, and a fourth movement transfer member for transforming rotary motion of the operating shaft into operating motion for the vacuum switch of the resistance branch.

Since the movement transfer members for the switches are separate from those for the contacts, the respective movement transfer member may be designed so as to be optimally adjusted to the respective movement that is to be carried out. Since each of the four units to be operated has an individual movement transfer member, this also leads to maximum flexibility as far as the relation between the various operating actions are concerned.

According to a further embodiment, at least one of, preferably both of, the third and fourth movement transfer members comprise a cam mechanism.

This is a simple and appropriate mechanism for transforming rotary motion into linear motion and is therefore advantageous to use for the operation of switches since in those cases it is normally a question of a linear operating motion.

According to yet a further preferred embodiment, the first, second, third and fourth movement transfer members are arranged such that operation of the main contact, the resistance contact, the vacuum switch of the main branch and the vacuum switch of the resistance branch, respectively, takes place in a predetermined sequence and at predetermined angular movements of the operating shaft.

During switching of the load, it is necessary for the different components to be operated in a predetermined sequence. With this embodiment, this is achieved in a simple manner by establishing the predetermined sequence by the mechanism of the movement transfer members. Further, there is an optimum time relationship for the various operations in the operating process. By activating the respective movement member in dependence on the angular position of the operating shaft, predetermined time relationship may be achieved in a safe and simple manner.

According to still another preferred embodiment, the operating device comprises a rotary shaft in driving connection with the operating shaft via a movement transformation member arranged to transform an alternating rotary motion of the drive shaft into a unidirectional rotary motion of the operating shaft.

By such a movement transformation member, the advantage is achieved that the unidirectional rotary motion may be achieved in a simple manner although the rotary motion comprised therein may be in different directions.

According to yet another preferred embodiment, the movement transformation member comprises a mechanical energy accumulation member arranged to receive energy from the rotary motion of the drive shaft during a first period of time and to deliver energy to the operating shaft during a second period of time, said second period of time being considerably shorter than said first period of time, preferably shorter than 10%.

For operation of the components of the diverter switch, a rapid process, with relatively great force, is required. With the energy accumulation member according to this embodiment, the advantage is achieved that this may be attained without the movement of the drive shaft having to be correspondingly fast and powerful.

According to still another embodiment, the drive shaft is mechanically connected to the guide member of a selector cooperating with the diverter switch, said guide member being so connected to the drive shaft that a rotary motion in different directions is imparted to the drive shaft depending on whether the transformer is controlled to a higher or a lower voltage.

Since a diverter switch often cooperates with a selector, wherein the guide member of the selector is rotated in different directions depending on whether it is a question of an increase or a decrease of the voltage, the possibility of unidirection of the rotary motion is especially valuable in this connection.

In accordance with another preferred embodiment of the invention, when the diverter switch also comprises a bypass branch comprising a bypass contact, the operating member is arranged, during operation, always to rotate the bypass contact in one and the same direction of rotation.

Because the movement pattern for the bypass contact is considerably simplified by the unidirectional movement, the disadvantages associated with the prior art are eliminated. In addition, the bypass contact may be designed in a very simple manner and with increased functional safety because the rotary motion is at all times directed in the same direction. Further, it will then be easier to mechanically fulfil the condition that the bypass contact should always be operated before the main contact which, in turn, is always operated before the resistance contact. This also makes possible a fast switching operation, which results in a minor load on the switching components. A switching operation with the diverter switch according to the invention takes place during a space of time of about 100 ms, and it is thus realized that the load current for almost 100% of the operating time will be passed through the bypass contact.

According to a preferred embodiment, the operating member is arranged to rotate the bypass contact, the main contact as well as the resistance contact in one and the same direction of rotation. According to another preferred embodiment, the bypass contact, the main contact and the resistance contact are arranged to be rotated in the same direction. This implies that the required movement transfer members may be designed in a simple manner.

According to an alternative preferred embodiment in relation to the immediately preceding one, two of the bypass contact, the main contact and the resistance contact are arranged to be rotated in a direction opposite to the third contact. In certain embodiments of the necessary movement transfer members or orientation of the contacts, this alternative embodiment may involve the simplest solution. According to a further preferred embodiment of the invented diverter switch, the operating member comprises an operating shaft, a first movement transfer member for transmitting rotary motion of the operating shaft to a rotary shaft of the main contact, a second movement transfer member for transmitting rotary motion of the operating shaft to a rotary shaft of the resistance contact, and a fifth movement transfer member for transmitting rotary motion of the operating shaft to a rotary shaft of the bypass contact. In this way, the contacts will be operated individually, which facilitates achieving small dimensions and low operating energy by the fact that the contacts may have shorter sliding distances and lower friction losses while maintaining their self-cleaning function. One consequence of this is also that pollution of the oil by means of wear particles may be kept low.

According to a further preferred embodiment, the fifth movement transfer member comprises a Geneva mechanism.

This is a mechanism especially suited for its purpose since it permits, by simple means, transformation of rotary motion into intermittent rotary motion, where the driven part of the mechanism after a rotary motion may be easily caused to assume a position where it is ready to be driven in a new similar movement. In addition thereto, the Geneva mechanism exhibits an inherent mechanical locking function. In addition, using a Geneva mechanism in a four-part design results in a rotary motion of 90°, which is appropriate in this context.

According to an additional preferred embodiment, the operating member is arranged to operate also the vacuum switch of the main branch and the vacuum switch of the resistance branch.

This results in the advantage that the whole switching procedure is initiated via one common operating member, which provides increased controllability and monitoring of the procedure.

According to yet another preferred embodiment, the operating member comprises a third movement transfer member for transforming rotary motion of the operating shaft into operating motion for the vacuum switch of the main branch, and a fourth movement transfer member for transforming rotary motion of the operating shaft into operating motion for the vacuum switch of the resistance branch.

Since the movement transfer members for the switches are separate from those for the contacts, the respective movement transfer member may be designed so as to be optimally adjusted to the respective movement that is to be carried out. Since each of the five units to be operated has an individual movement transfer member, this also leads to maximum flexibility as far as the relation between the various operating actions are concerned.

According to yet a further preferred embodiment, the first, second, third, fourth and fifth movement transfer members are arranged such that operation of the main contact, the resistance contact, the vacuum switch of the main branch and the vacuum switch of the resistance branch, respectively, as well as the bypass contact takes place in a predetermined sequence and at predetermined angular movements of the operating shaft.

During switching of the load, it is necessary for the different components to be operated in a predetermined sequence. With this embodiment, this is achieved in a simple manner by establishing the predetermined sequence by the mechanism of the movement transfer members. Further, there is an optimum time relationship for the various operations in the operating process. By activating the respective movement member in dependence on the angular position of the operating shaft, predetermined time relationship may be achieved in a safe and simple manner. Said embodiments also make it possible for the different components of the diverter switch to be built together for forming an integrated unit.

According to the second aspect of the invention, the object set is achieved in that a method that includes the special measure that, during operation, the main contact is always rotated in one and the same direction of rotation. This results in advantages of a kind similar to those gained with the invented diverter switch and which have been described above.

This results in advantages of a kind similar to those gained with the invented diverter switch and which have been described above.

The invention will be explained in greater detail in the subsequent description of advantageous embodiments of the same with reference to the accompanying drawings.

DESCRIPTION OF THE PREFERRED EMBODIMENT

Figure 1:
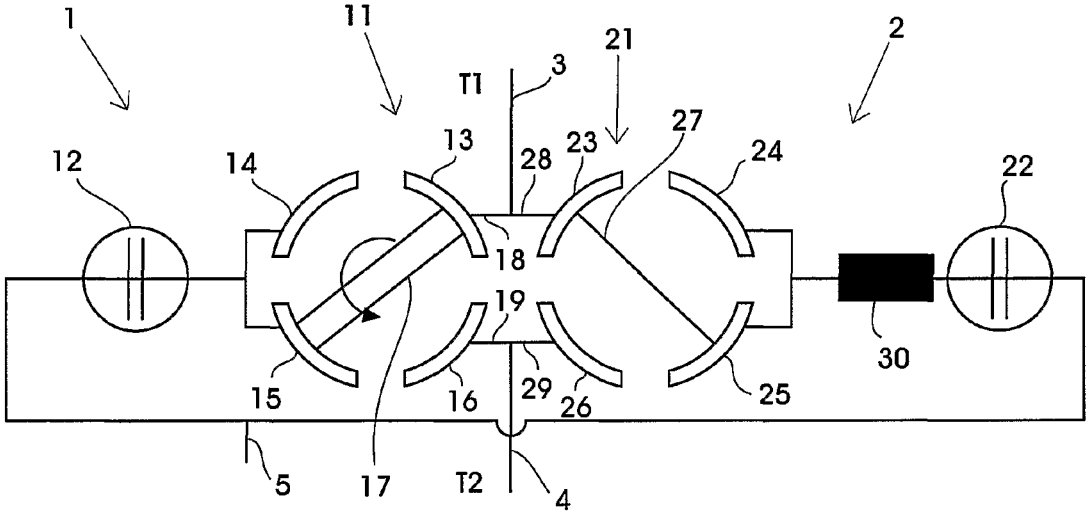
FIG. 1 is a circuit diagram for a phase of a diverter switch according to one embodiment of the invention.

FIG. 1 is a circuit diagram illustrating a diverter switch of the kind to which the present invention relates. The figure shows switching of one phase only and it should be clear that a corresponding diverter switch is arranged for each phase in case of, for example, a three-phase design. The diverter switch has a main branch 1 and a resistance branch 2 connected in parallel therewith. The main branch 1 comprises a rotary selector contact 11 in series with a vacuum switch 22. Similarly, the resistance branch comprises a resistance contact 21 and a vacuum switch 22. The resistance branch 2 also comprises a resistance 30. The main contact has a movable contact member 17 which is designed to be rotatable in a counterclockwise direction, as is shown in the embodiment according to FIG. 1, and four fixed contact members 13-16. The movable contact member 17 is designed to contact the fixed contact members pairwise to alternate the connection. The resistance contact 21 has the same fundamental composition and function.

In the position shown, the diverter switch is in a position where it connects an output line 5 to a line 3 connected to a tapping point of, for example, a transformer. It may be mentioned here that, in a diverter switch of a three-phase design, the line 5 corresponds to the common neutral point. Numeral 4 designates the line to a second tapping point of the transformer. The connections of lines 3 and 4 to the relevant tapping point of the transformer are achieved by a selector (not shown in the figure). Line 3 is connected, via a branch 28, to the fixed contact members 13 and 23. Line 4 is connected, via a branch 29, to the fixed contact members 16 and 26.

When the diverter switch is to switch the output line 5 so that it is connected to the tapping point, connected to line 4, from the position shown in the figure where the output line 5 is connected to the tapping point connected to line 3, this takes place in the following steps:

1 The vacuum switch 12 of the main branch is opened, resulting in the load current being transferred to the resistance branch.

2 The main contact 11 is operated by rotating its movable contact member 17 90 degrees in the counter-clockwise direction from the position shown in the figure, where it contacts the pair of fixed contact members 13, 15, to a position where it contacts the pair of fixed contact members 14, 16.

3 The vacuum switch 12 of the main branch is closed, whereby the load current is taken over and circulation current starts floating.

4 The vacuum switch 22 of the resistance branch is opened, thus breaking the circulation current.

5 The resistance contact 21 is operated by rotating its movable contact member 27 90 degrees in a counter-clockwise direction from the position shown in the figure, where it contacts the pair of fixed contact members 23, 25, to a position where it contacts the pair of fixed contact members 24, 26.

6 The vacuum switch of the resistance branch is closed.

In the closed position, the output line 5 is connected to that tapping point on the transformer which is connected to the line 4.

When the diverter switch next time is to be operated, this occurs in a corresponding way so that the main contact and the resistance contact also in this case are rotated in the same direction as previously, that is, counter-clockwise.

Figure 2:
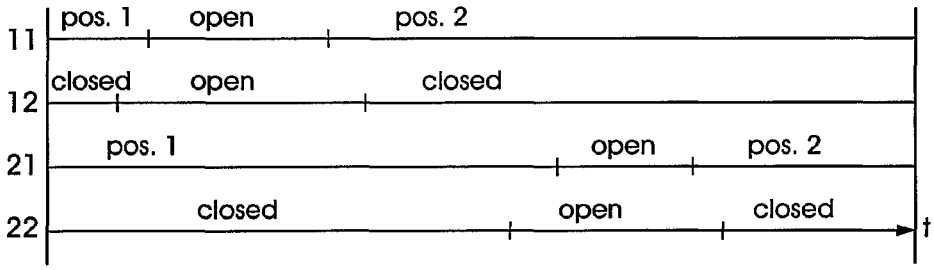
FIG. 2 is a diagram illustrating the status of the components of the diverter switch with respect to time for a diverter switch according to FIG. 1.

FIG. 2 illustrates the process in a diagram with the x-axis as the time axis. The state of each component 11, 12, 21 and 22 during different stages of the process is indicated. For the main contact 11, position 1 means that the fixed contact members 13 and 15 are connected and position 2 means that the fixed contact members 14 and 16 are connected. For the resistance contact 21, position 1 means that the fixed contact members 23 and 25 are connected and position 2 means that the fixed contact members 24 and 26 are connected.

Figure 3:
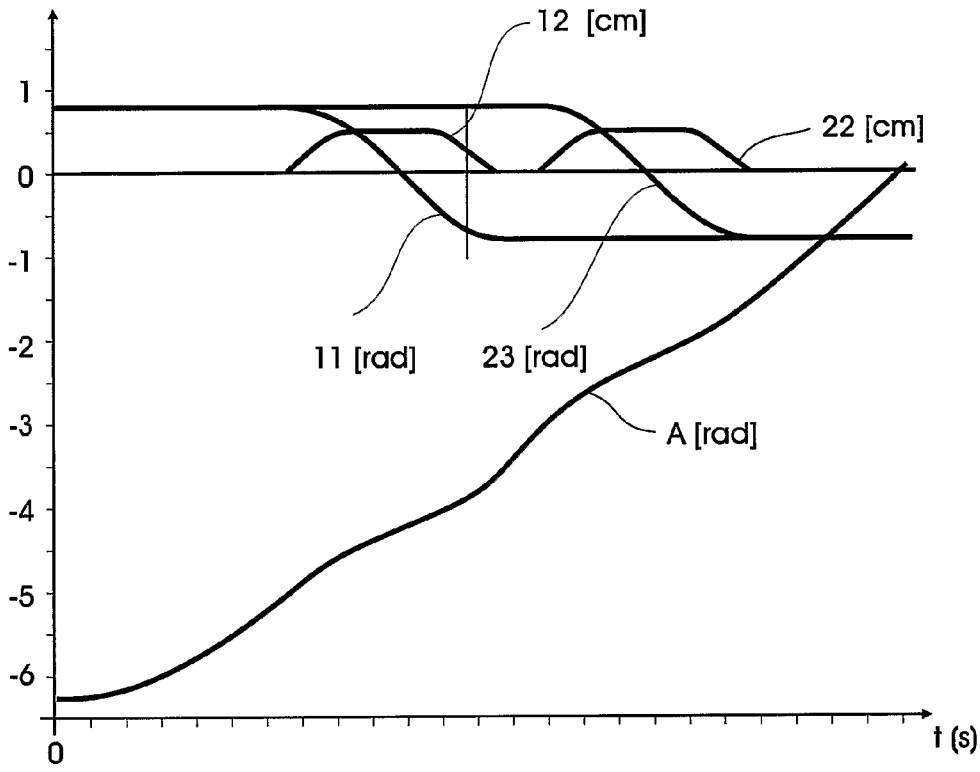
FIG. 3 is a diagram illustrating the movement of the components of the diverter switch with respect to time for a diverter switch according to FIG. 1.

FIG. 3 illustrates the process in a diagram with the x-axis as the time axis and where the circuit breakers and the positions of the rotary selector contacts in relation to the respective initial positions are indicated in centimeters and radians on the y-axis. The movement curves of the different components are indicated with the reference numeral of the respective component.

The movement curve A indicates the rotary motion of an operating shaft which, via movement transfer members, transmits the movement to the respective component.

Figure 4:
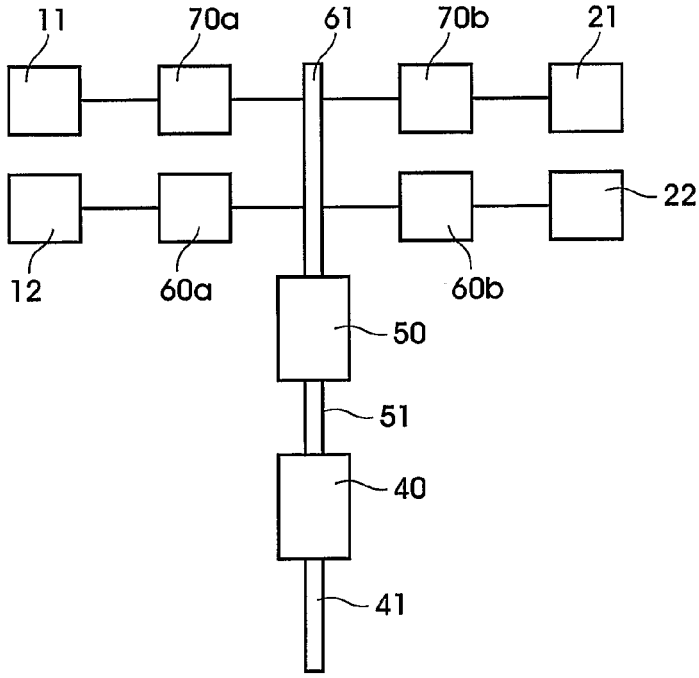
FIG. 4 is a block diagram illustrating the mechanical force transmission in a diverter switch according to FIG. 1.

FIG. 4 is a block diagram schematically illustrating the mechanical operating members that achieve the movement of the components of the diverter switch.

An input drive member 41 is connected to an intermediate shaft 51 via a movement transformation member 40. The drive member 41 is such that, when being operated, it may rotate in one or the other direction. The movement transformation member 40 is designed such that a rotary motion is always imparted to the intermediate shaft 51 in one and the same direction independently of in which direction the drive shaft 41 is rotated.

When the intermediate shaft 51 is rotated, it feeds energy into a mechanical energy accumulator 50. After a definite angular motion of the intermediate shaft, the accumulated energy is released, the operating shaft 61 thus being rapidly and powerfully rotated. The rotation of the operating shaft is transformed via movement transfer members 70*a* and 70*b* into a rotary motion of the main contact 11 and the resistance contact 21, respectively, and via movement transfer members 60*a* and 60*b* into a translatory motion of the vacuum switch 12 of the main branch and the vacuum switch 22 of the resistance branch, respectively. This results in the sequence of movements of the diverter switch described above with reference to FIGS. 1, 2 and 3.

The movement transformation member 40 illustrated in FIG. 4 substantially consists of a system of cooperating gear wheels. The energy accumulator 50 substantially consists of a torsion spring of a flat helical spring type. Alternatively, the energy accumulator 50 may substantially be in the form of a plurality of flat helical springs connected in parallel with each other. The helical spring or springs in the energy accumulator are always tensioned in one and the same direction of rotation, that is, the spring/springs preferable exhibit a predetermined charge direction and discharge direction, respectively, independently of in which direction the drive member 41 rotates. The movement transfer members 70*a* and 70*b* are substantially in the form of Geneva mechanisms and the movement transfer members 60*a* and 60*b* are substantially in the form of cam mechanisms. These different units in the greater detail below with reference to FIGS. 5-11.

Figure 1A:
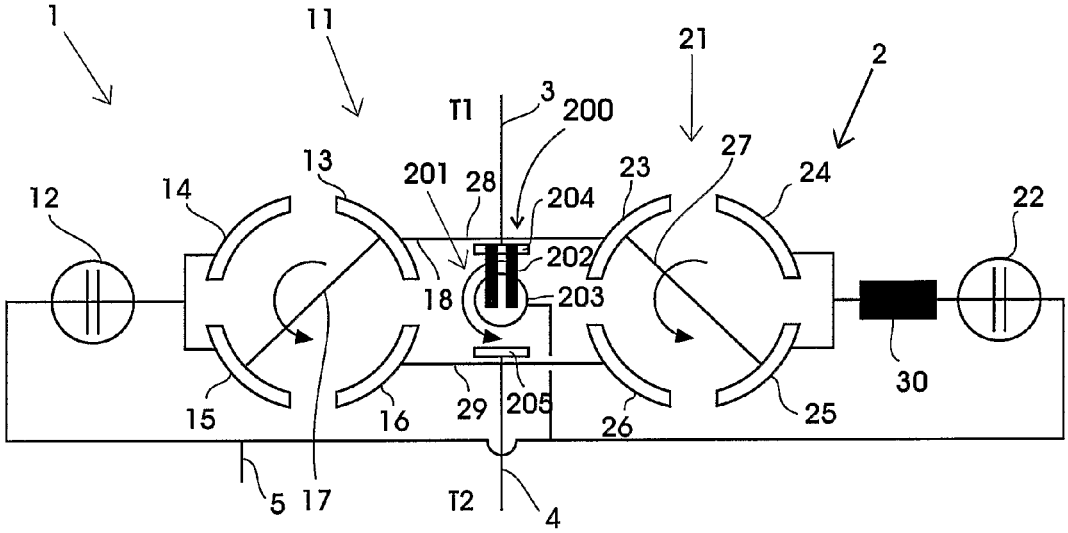
FIG. 1*a* is a circuit diagram for a phase of a diverter switch according to one embodiment of the invention with a bypass function.

FIG. 1*a* is a circuit diagram illustrating a diverter switch of the kind having a bypass function according to claim 12. The diverter switch according to FIG. 1*a* is provided with a bypass branch 200 with a bypass contact 201. The bypass contact 201 comprises a movable contact member 202 which at its fixed end is electrically connected to a contact member 203 and at its movable end is alternately connected to the contact members 204 and 205.

In the position shown, the main part of the load current is passed from the line 3 via the bypass contact 201 through the contact members 204 and 203 to the line 5. In this way, the vacuum switch 12 is not loaded to any major extent, since the resistance through the bypass contact 201 is lower than the resistance of the vacuum switch.

When the diverter switch is to switch the output line 5 so that it is connected to the tapping point, connected to line 4, from the position shown in the figure where the output line 5 is connected to the tapping point connected to line 3, this takes place in the following steps:

1 The bypass switch 201 of the bypass branch is opened by rotating its movable contact member 202 90 degrees in a counter clockwise direction, resulting in the contact between the contact members 203, 204 being broken and the load current being transferred to the vacuum switch 12 of the main branch.

2 The vacuum switch 12 of the main branch is opened, resulting in the load current being transferred to the resistance branch.

3 The main contact 11 is operated by rotating its movable contact member 17 90 degrees in a counterclockwise direction from the position shown in the figure, where it contacts the pair of fixed contact members 13, 15, to a position where it contacts the pair of fixed contact members 14, 16.

4 The vacuum switch 12 of the main branch is closed, whereby the load current is taken over and circulation current starts floating.

5 The vacuum switch 22 of the resistance branch is opened, thus breaking the circulation current.

6 The resistance contact 21 is operated by rotating its movable contact member 27 90 degrees in a counter clockwise direction from the position shown in the figure, where it contacts the pair of fixed contact members 23, 25, to a position where it contacts the pair of fixed contact members 24, 26.

7 The vacuum switch of the resistance branch is closed.

8 The bypass switch 201 of the bypass branch is closed by rotating its movable contact member 202 90 degrees in a counter clockwise direction, resulting in the contact members 203, 205 being closed and the load current being transferred from the vacuum switch 12 of the main branch to the bypass switch 201.

In the closed position, the output line 5 is connected to that tapping point on the transformer which is connected to the line 4. When the diverter switch next time is to be operated, this occurs in a corresponding way so that the bypass contact, the main contact and the resistance contact also in this case are rotated in the same direction as previously, that is, counter-clockwise.

Figure 2A:
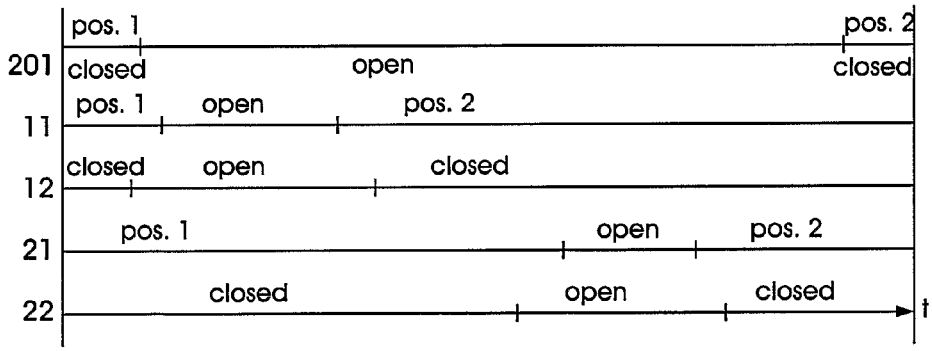
FIG. 2*a* is a diagram illustrating the status of the components of the diverter switch with respect to time for a diverter switch according to FIG. 1*a*.

FIG. 2*a* illustrates the process in a diagram with the x-axis as the time axis. The state of each component 201, 11, 12, 21 and 22 during different stages of the process is indicated. For the bypass contact, position 1 means that the fixed contact members 203 and 204 are connected and position 2 means that the fixed contact members 203 and 204 are connected. For the main contact 11, position 1 means that the fixed contact members 13 and 15 are connected and position 2 means that the fixed contact members 14 and 16 are connected. For the resistance contact 21, position 1 means that the fixed contact members 23 and 25 are connected and position 2 means that the fixed contact members 24 and 26 are connected.

Figure 4A:
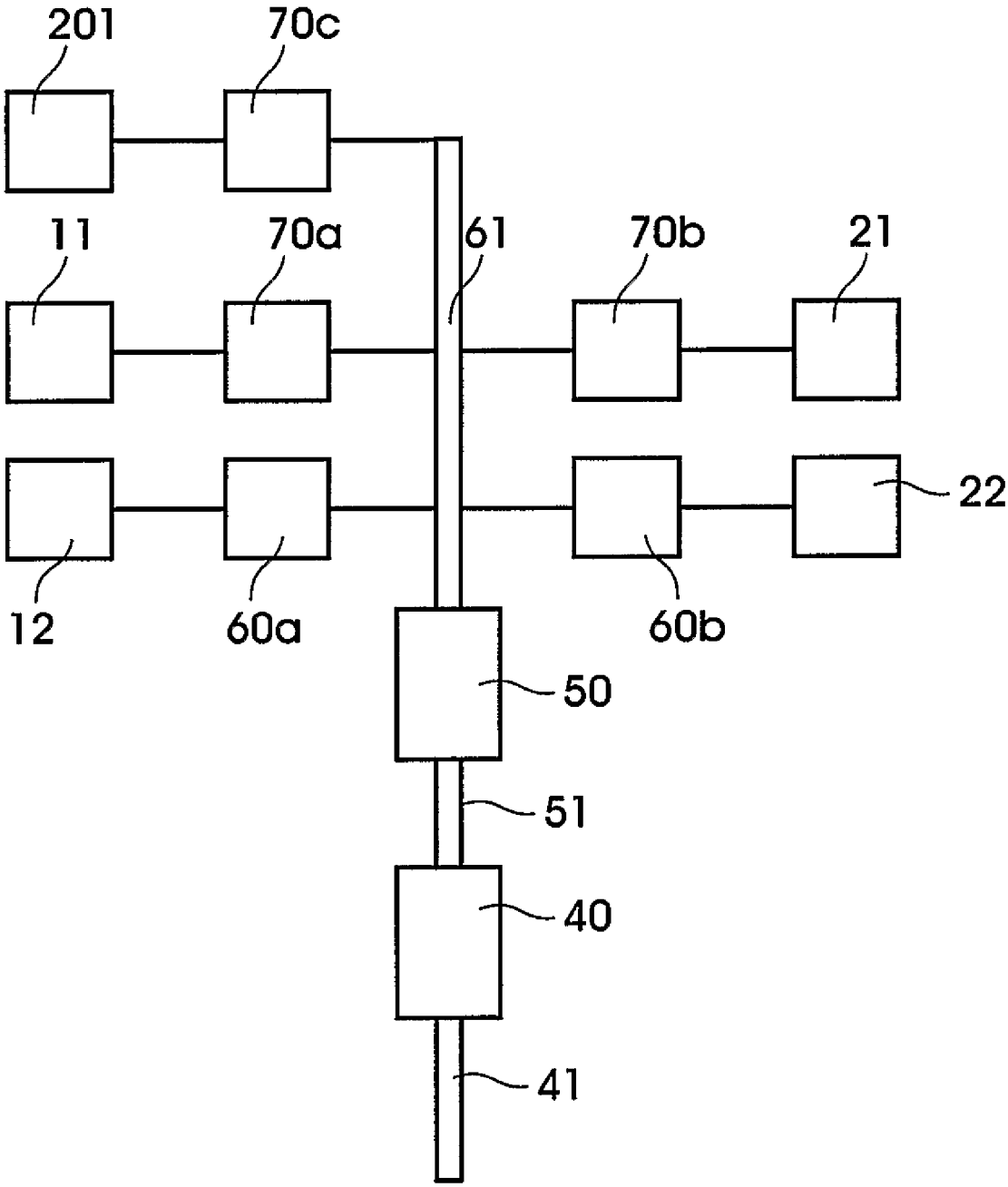
FIG. 4*a* is a block diagram illustrating the mechanical force transmission in a diverter switch according to FIG. 1*a*.

FIG. 4*a* is a block diagram that schematically illustrates the mechanical operating member that brings about the movement of the components of the diverter switch.

An input drive member 41 is connected to an intermediate shaft 51 via a movement transformation member 40. The drive member 41 is such that, when being operated, it may rotate in one or the other direction. The movement transformation member 40 is designed such that a rotary motion is always imparted to the intermediate shaft 51 in one and the same direction independently of in which direction the drive member 41 is rotated.

When the intermediate shaft 51 is rotated, it feeds energy into a mechanical energy accumulator 50. After a definite angular motion of the intermediate shaft, the accumulated energy is released, the operating shaft 61 thus being rapidly and powerfully rotated. The rotation of the operating shaft is transformed via movement transfer members 70*a*, 70*b* and 70*c* into a rotary motion of the main contact 11 and the resistance contact 21, respectively, as well as the bypass contact 201 and via movement transfer members 60*a* and 60*b* into a translatory motion of the vacuum switch 12 of the main branch and the vacuum switch 22 of the resistance branch, respectively. This results in the sequence of movements of the diverter switch described above with reference to FIGS. 1*a* and 2*a*.

The movement transformation member 40 illustrated in FIG. 4*a* substantially consists of a system of cooperating gear wheels as shown in FIG. 4. The energy accumulator 50 substantially consists of a torsion spring of a flat helical spring type. Alternatively, the energy accumulator 50 may substantially be in the form of a plurality of flat helical springs connected in parallel with each other. The helical spring or springs in the energy accumulator are always tensioned in one and the same direction of rotation, that is, the spring/springs preferably exhibit a predetermined charge direction and discharge direction, respectively, independently of in which direction the drive shaft 41*a* rotates. The movement transfer members 70*a*, 70*b* and 70*c* are substantially in the form of Geneva mechanisms and the movement transfer members 60*a* and 60*b* are substantially in the form of cam mechanisms.

These different units are described in the following with reference to FIGS. 5-11 but alternative embodiments are also possible.

Figure 5:
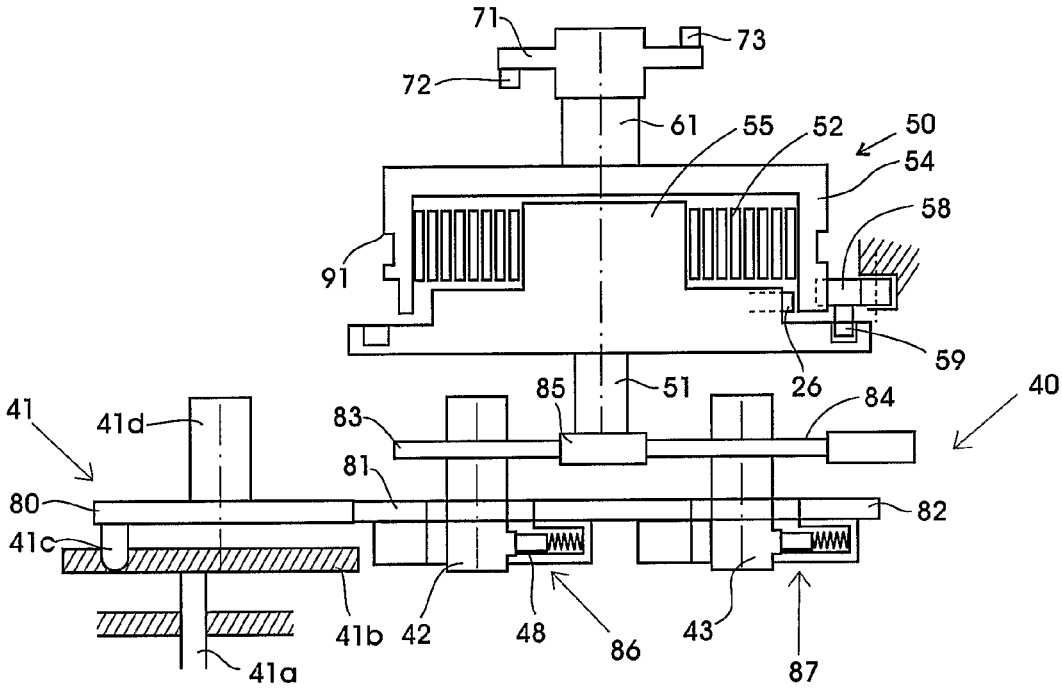
FIG. 5 is a longitudinal section through a detail of the force transmission illustrated in FIG. 4.

FIG. 5 is a schematic longitudinal section through a drive member 41 comprising an input drive shaft 41*a* and a drive pulley 41*b* connected thereto, a cylindrical gear wheel 80, a driving pin 41*c* and a shaft 41*d* rigidly connected to the gear wheel 80, the movement transformation member 40, the intermediate shaft 51, the energy accumulator 50, and the operating shaft 61. The cylindrical gear wheel 80 is in engagement with the drive pulley 41*b* by means of the driving pin 41*c* via a recess in the drive pulley 41*b*. The driving pin 41*c* is thus adapted to transmit rotary motion from the drive shaft 41*a* to the gear wheel 80. The drive pulley 41*b* constitutes the mechanical interface in the diverter switch housing which is separate from the diverter switch.

The input drive shaft 41*a* is thus connected to the intermediate shaft 51 via a number of cylindrical gear wheels, that is, to the shaft that leads to the operation of the diverter switch.

The gear wheel 80 is rigidly connected to the shaft 41*d* and in engagement with the gear wheel 81, which in turn is in engagement with the gear wheel 82. By means of a ratchet gearing 86 with a pawl 48, the gear wheel 81 is connected to a shaft 42 that is rigidly connected to the gear wheel 83, and by means of a corresponding ratchet gearing 87, the gear wheel 82 is connected to a shaft 43 that is rigidly connected to the gear wheel 84. Each ratchet gearing 86, 87 is designed to transmit rotary motion in a clockwise direction from the lower gear wheel to the respective upper wheel and to freewheel, that is, allow relative rotation during a counterclockwise rotary motion of the respective lower gear wheel. Each of the two upper gear wheels 83, 84 is in a driving connection with a gear wheel 85 for transmission of rotary motion to the intermediate shaft 51.

The intermediate shaft 51 is always rotated in one and the same direction independently of whether the input drive shaft is rotated in a clockwise or a counterclockwise direction.

Figure 8:
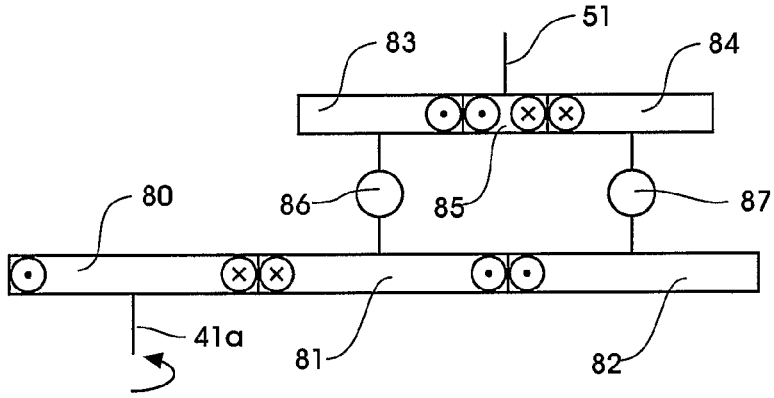
FIG. 8 illustrates the transmission of movement of details shown in FIG. 5.
Figure 9:
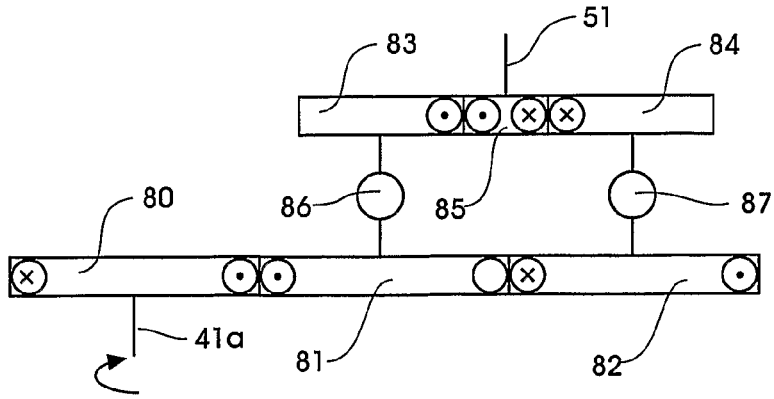
FIG. 9 illustrates transmission of movement corresponding to that of FIG. 8 for a different operational situation.

FIGS. 8 and 9 illustrate this manner of operation of the movement transformation member 40.

In FIG. 8, the gear wheel 80 is rotated in a counterclockwise direction by the drive shaft 41*a*, as marked with symbols on the gear wheel. This results in a clockwise rotation of the gear wheel 81 and a counterclockwise rotation of the gear wheel 82. This will also cause the gear wheel 83 to accompany the gear wheel 81 in its clockwise rotation and to drive the intermediate shaft 51 in a counterclockwise rotation via the gear wheel 85.

Since the gear wheel 82 is rotated in a counterclockwise direction, this rotary motion will not be transmitted to the gear wheel 84. The latter will therefore not take part in the transmission of rotary motion but will only be rotated in a clockwise direction, substantially with no torque, as a result of the engagement with the gear wheel 51.

In FIG. 9, the rotary direction of the drive shaft 41*a* is the opposite, that is, clockwise. By applying a similar reasoning as that above, it is easily realized that, also in this case, the output shaft 51 will be rotated in a counterclockwise direction via the gear wheels 80, 81, 82, 84 and 85, whereas in this case the gear wheel 83 does not take part in the transmission of the rotary motion.

In the shown example according to FIG. 5, the energy accumulator 50 that connects the intermediate shaft 51 to the operating shaft 61 comprises a flat helical spring 52. This spring is supported at one end by a holding means (not shown) on a drum 54 rigidly connected to the operating shaft 61. The other end of the helical spring makes contact with a carrier element 55 rigidly connected to the intermediate shaft 51. A catch 58 is designed to lock the drum 54 and hence also the operating shaft 61 against rotation. The catch is designed to be released by means of a release mechanism 59, allowing the drum 54 and the operating shaft to be rotated.

During operation, when the intermediate shaft 51 is rotated clockwise, the carrier element 55 accompanies the shaft in this movement, and, by its contact with the spring 52, it will tension the spring so as to achieve an energy accumulation. The release mechanism 59 is designed to release the catch 58 after a predetermined rotary motion, typically smaller than 360°, preferably about 310°. The spring mechanism results in a strong time ratio. Whereas the time for rotating the shaft 51 may typically amount to about 5 seconds, the rotation of the operating shaft 61 occurs during a time of approximately 0.2 seconds.

The movement of the operating shaft 61 is then transmitted via a cam slot 91 to the vacuum switches and a mechanism 71 with pins 72, 73 to the contacts.

Since the unification of the movement of the intermediate shaft 51 and the energy accumulation is achieved by means of preferably modularizable mechanisms which are separate from each other, the device will be simple, flexible and robust.

Figure 6:
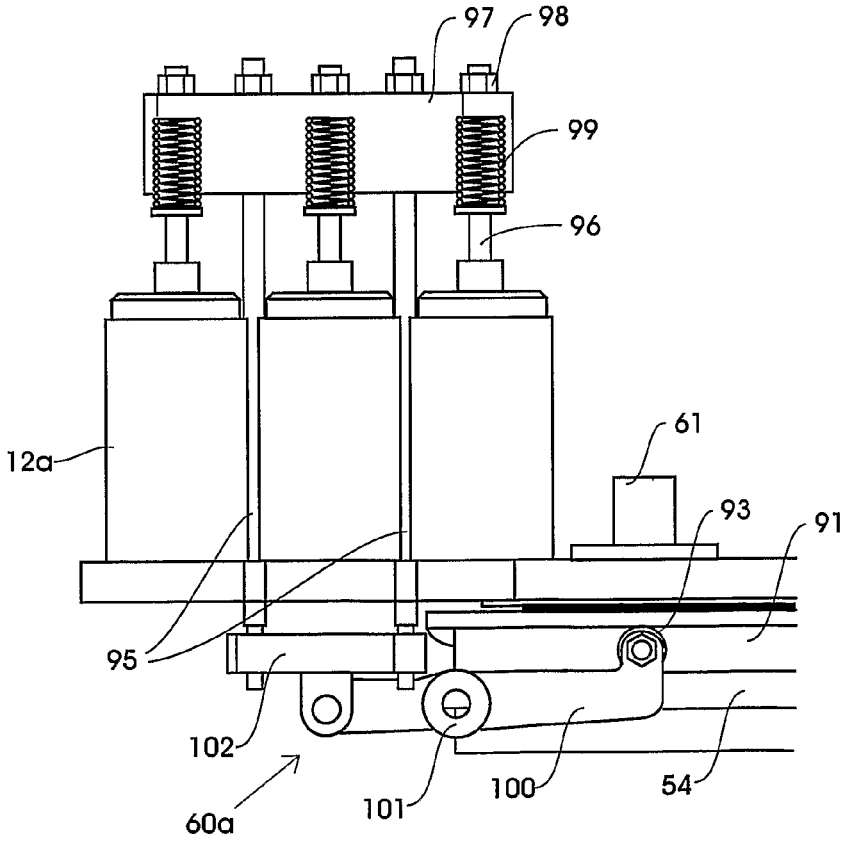
FIG. 6 is a side view through other details of the force transmission illustrated in FIG. 4.

FIG. 6 illustrates the principle of how the rotary motion of the operating shaft 61 is transmitted, via the movement transfer members 60*a*, 60*b*, to the respective vacuum switches 12, 22.

In the drum 54 of the drive shaft 61, a cam slot 91 is arranged. A cam follower 93 runs in the cam track, and the cam track 91 guides the cam follower 93 in a vertical movement pattern in the figure. The cam follower 93 is attached to a rocker arm 100 which is pivotally suspended from a support 101 and is rotatable about an axis perpendicular to the plane of the figure. The rocker arm 100 is connected at its other end to a lower yoke 102, which via operating rods 95 is attached to an upper yoke 97. The upper yoke is connected via operating rods 96 to the main vacuum switch 12*a* in the respective phase. The operating rods 96 are connected to the upper yoke via a respective spring 99, the point of engagement of which may be adjusted with the aid of a nut 98.

In addition thereto, the operating shaft 61 is provided with a Geneva mechanism 71, rigidly connected thereto, with two axially directed pins 72, 73 for transmitting motion to the rotary selector contacts 11, 21 via the movement transfer members 70*a*, 70*b* (see FIG. 4).

Figure 7:
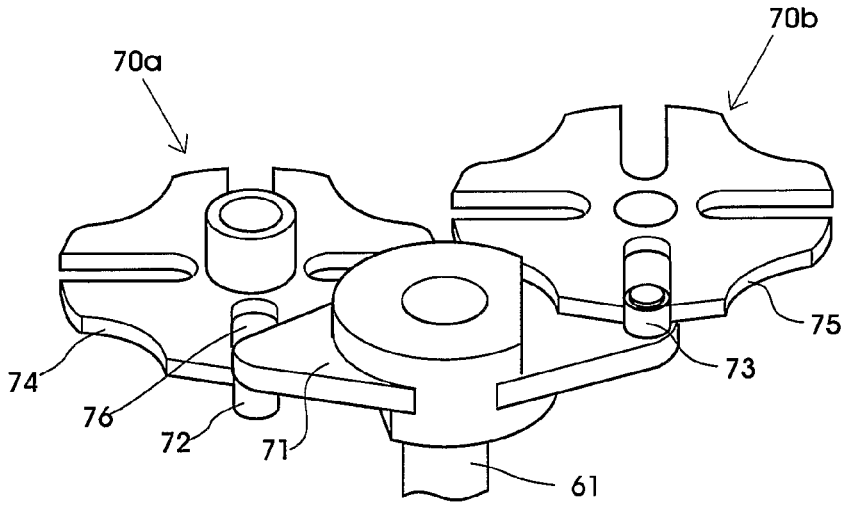
FIG. 7 is a perspective view through further details of the force transmission illustrated in FIG. 4.

These movement transfer members are illustrated in greater detail in FIG. 7, which shows a perspective view of the two Geneva mechanisms which constitute said movement transfer members 70*a*, 70*b*.

The two pins 72, 73 arranged on the Geneva mechanism 71 are located at a definite angular distance from each other. On each side is a Geneva wheel 74, 75, arranged to cooperate with the pins. When the operating shaft 61 is rotated clockwise, the pin 72 will, in a certain angular position, enter into the slot 76 in the lefthand Geneva wheel 74, hence rotating this wheel counterclockwise until the pin 72 leaves the slot, which occurs after a quarter of a turn. The Geneva wheel 74 is rigidly connected, with a shaft (not shown), to the movable contact member 17 in the main contact 11 (see FIG. 1).

Thereafter, the Geneva wheel 74 remains stationary and with the subsequent slot being prepared to receive the pin 72 when a movement is to be initiated next time.

In a corresponding way, the pin 73 cooperates with the righthand Geneva wheel 75 for operation of the resistance contact 21. The time relationship between the operation of the respective rotary selector contact will be determined by the mechanics of the Geneva mechanisms. For example, a different time relationship may be obtained by selecting a different relative mutual angular position for the pins 72, 73 from what has been shown in FIG. 7.

When the cam slot 91 illustrated in FIG. 6 and the Geneva mechanism 71 illustrated in FIG. 7 are both rotated along with the movement of the operating shaft 61, the profile of the cam slot 91 and the positions for the pins 72, 73 engaging into the respective Geneva wheel may be synchronized to achieve a definite sequence and time relationship for the four components 11, 12, 21, 22 of the diverter switch.

Figure 10:
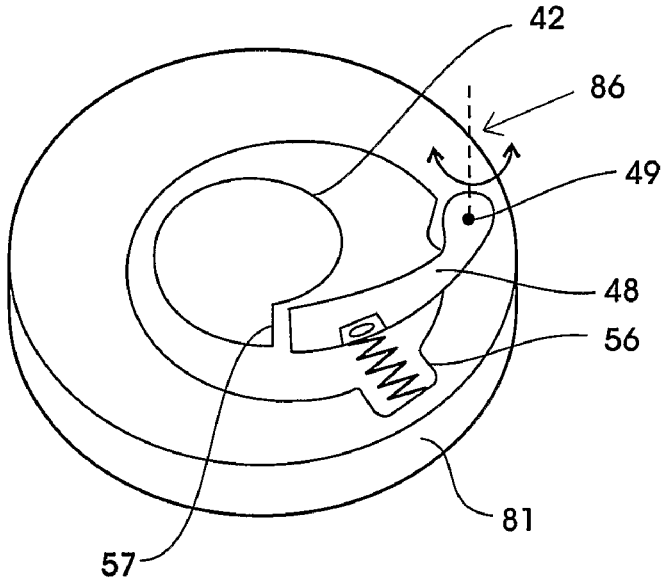
FIG. 10 illustrates a detail related to FIG. 5.
Figure 11:
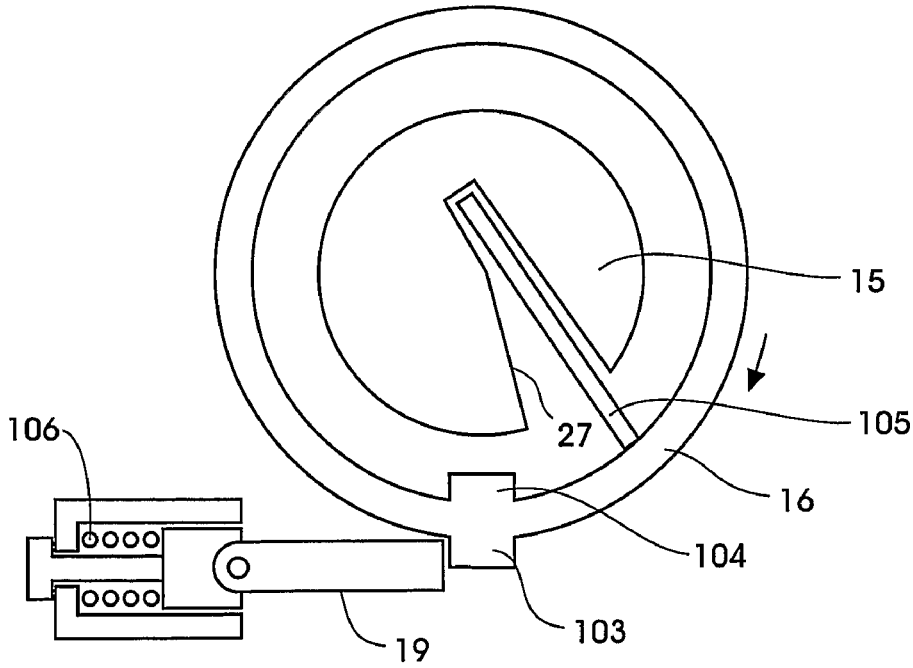
FIG. 11 illustrates a further detail related to FIG. 5.

FIG. 10 illustrates the locking mechanism that corresponds to parts 86, 87 in FIG. 5. The outer wheel ring may be assumed to be constituted by the gear wheel 81 which is arranged to transmit a conditioned rotary motion to the shaft 42 that is rigidly connected to the gear wheel 83. The wheel 81 is provided with a spring-loaded pawl 48 rotatable about an axis of rotation 49 which is parallel to the intermediate shaft 42. In the cylindrical opening of the wheel 81, there is a recess 56 that is large enough to accommodate the pawl when in its depressed position. On that part of the shaft 42 which in the figure is located axially opposite to the pawl 48, the shaft 42 is provided with a radially directed notch 57 that renders the circumferential surface slightly helical.

When the wheel 81 is rotated clockwise, the pawl 48 will press against the notch 57, thus forcing the shaft 52 to rotate along with it. If, on the other hand, the wheel 81 is rotated in a counterclockwise direction, the shaft 42 will not be carried along. This causes the pawl 48 to be gradually pressed into the recess 56, and after a completed turn it will again snap up into the shown position. According to an alternative embodiment, the wheel 81 is provided with a leaf spring, which has a function corresponding to that of the spring-loaded pawl.

The drum 54 (see FIG. 5), connected to the driven shaft 61, is provided with a device for braking the rotation of the drum in the end position, that is, after almost one turn, whereby the braking power is transmitted to the rotary element 55 that is connected to the intermediate shaft 51. This device is illustrated schematically in FIG. 11, which shows the device immediately before the catch is released to permit rotation of the drum 54. The drum 54 is provided with an outer lug 103 arranged on the outside and an inner lug 104 arranged on the inside. In the figure, the outer lug makes contact with the catch 19. In the carrier element 55, a brake spring 105 is mounted. The carrier element 55 exhibits a sector-shaped recess 27, which permits the brake spring 105 to be bent outwards and hence be tensioned.

When the drum 54 is released for rotation by releasing the catch 19, the drum will be rotated at a high speed in a clockwise direction in the figure until the inner lug of the drum 55(?) strikes against the brake spring 105.

When the lug 104 strikes against the brake spring 105, it results in the brake spring being bent in a clockwise direction in the figure, and in rotary motion being transmitted to the carrier element 55. By the resilient impact via the brake spring, a smooth transfer of the rotary motion takes place. When the carrier element rotates along, this results in the helical spring 52 (see FIG. 5) being tensioned again. This results in surplus energy from the drum 54 being transferred to the helical spring 52 to be utilized for the next working stroke.

In this way, the drum 54 causes the carrier element 55 to rotate along with it until 360° has been completed, whereby the outer lug 103 of the drum strikes against the catch 19. To take up any remaining kinetic energy of the drum 54, the catch 19 is provided with a damping spring 106 arranged in a damping unit. The damping unit may be formed such that also viscous damping is achieved in connection with the damping spring 106 being activated (compressed).

The system of gear wheels described with reference to FIGS. 5, 8 and 9, for achieving a unidirectional movement of the intermediate shaft 51, may alternatively be replaced by a system of conical gear wheels. In this case, the drive shaft is provided with a bevel gear wheel with a 45° skew that cooperates with a corresponding bevel gear wheel arranged on the intermediate shaft 51. The latter is connected by means of an intermediate conical wheel to a second conical wheel arranged on the intermediate shaft 51. The two gear wheels arranged on the intermediate shaft are connected thereto with a ratchet gearing of a kind corresponding to that illustrated in FIG. 10.

The invention claimed is:

1. A diverter switch, comprising:

an operating member; and an electric circuit comprising a main branch and a resistance branch, wherein said main branch comprises a main contact and a main vacuum switch and said resistance branch comprises a resistance contact, a resistance vacuum switch and a resistance, said operating member being arranged, during operation, first to operate the main contact and then the resistance contact, wherein the operating member is arranged, during operation, always to rotate at least the main contact in one direction of rotation, wherein the operating member comprises an operating shaft, a first movement transfer member configured to transmit rotary motion of the operating shaft to a rotary shaft of the main contact, and a second movement transfer member configured to transmit rotary motion of the operating shaft to a rotary shaft of the resistance contact.

2. The diverter switch according to claim 1, wherein the operating member is arranged, during operation, always to rotate the resistance contact in one direction of rotation.

3. The diverter switch according to claim 2, wherein the main contact and the resistance contact are arranged to be rotated in a same direction.

4. The diverter switch according to claim 2, wherein the main contact and the resistance contact are arranged to be rotated in opposite directions.

5. The diverter switch according to claim 1, wherein said first movement transfer member and said second movement transfer member are arranged such that rotation of the resistance contact occurs when the operating shaft has been rotated through a predetermined angle from a position when rotation of the main contact occurs.

6. The diverter switch according to claim 1, wherein at least one of said first movement transfer member and said second movement transfer member comprises a Geneva mechanism.

7. The diverter switch according to claim 1, wherein the operating member is arranged to operate also the main vacuum switch and the resistance vacuum switch.

8. The diverter switch according to claim 7, wherein the operating member comprises a third movement transfer member configured to transform rotary motion of the operating shaft into operating motion for the main vacuum switch, and a fourth movement transfer member configured to transform rotary motion of the operating shaft into operating motion for the resistance vacuum switch.

9. The diverter switch according to claim 8, wherein at least one of said third movement transfer member and said fourth movement transfer member comprises a cam mechanism.

10. The diverter switch according to claim 8, wherein said first movement transfer member, said second movement transfer member, said third movement transfer member and said fourth movement transfer member are arranged such that operation of the main contact, the resistance contact, the main vacuum switch and the resistance vacuum switch occurs in a predetermined sequence and at predetermined angles of the movement of the operating shaft.

11. The diverter switch according to claim 1, wherein the electric circuit further comprises a bypass branch comprising a bypass contact, and wherein the operating member is arranged, during operation, always to rotate the bypass contact in one direction.

12. The diverter switch according to claim 11, wherein the bypass contact, the main contact and the resistance contact are arranged to be rotated in the one direction.

13. The diverter switch according to claim 12, wherein two of the bypass contact, the main contact and the resistance contact are arranged to be rotated in a direction opposite to that of the third contact.

14. The diverter switch according to claim 1, wherein the operating member comprises a drive member in driving connection with the operating shaft via movement transfer member arranged to transform an alternating rotary motion of the drive member into a unidirectional rotary motion of the operating shaft.

15. The diverter switch according to claim 14, wherein the movement transfer member comprises a mechanical energy accumulation member arranged to receive energy from the rotary motion of the drive member during a first period of time and to deliver energy to the operating shaft during a second period of time, said second period of time being considerably shorter than said first period of time.

16. The diverter switch according to claim 1, wherein a drive member is mechanically connected to a guide member of a selector cooperating with the diverter switch, said guide member being so connected to the drive member that a rotary motion is imparted to the drive member in different directions depending on whether a transformer is controlled to a higher or lower voltage.

17. A method for operating a diverter switch, said diverter switch comprising an operating member comprising an operating shaft and an electric circuit comprising a main branch and a resistance branch, wherein said main branch comprises a main contact and a vacuum switch and wherein said resistance branch comprises a resistance contact, a resistance vacuum switch and a resistance, the method comprising:

operating the main contact with the operating member then operating the resistance contact with the operating member, wherein during operation, the operating member rotates the main contact in one direction of rotation;

transmitting with a first movement transfer member rotary motion of the operating shaft to a rotary shaft of the main contact; and transmitting with a second movement transfer member rotary motion of the operating shaft to a rotary shaft of the resistance contact.

18. The method for operating a diverter switch according to claim 17, wherein said diverter switch further comprises a bypass branch, wherein the bypass branch comprises a bypass contact, the method further comprising:

operating the bypass contact before the main contact during operation, wherein during operation, the bypass contact is always rotated in one direction of rotation.

19. The method according to claim 17, further comprising: utilizing the diverter switch to control a transformer.

20. The method according to claim 17, further comprising: utilizing the diverter switch to control a reactor.

21. The method according to claim 17, further comprising: utilizing the diverter switch to control a capacitor.

22. A diverter switch, comprising:

an operating member; and an electric circuit comprising a main branch and a resistance branch, wherein said main branch comprises a main contact and a main vacuum switch and said resistance branch comprises a resistance contact, a resistance vacuum switch and a resistance, said operating member being arranged, during operation, first to operate the main contact and then the resistance contact, wherein the operating member is arranged, during operation, always to rotate at least the main contact in one direction of rotation, wherein the electric circuit further comprises a bypass branch comprising a bypass contact, wherein the operating member is arranged, during operation, always to rotate the bypass contact in one direction, and wherein the operating member comprises an operating shaft, a first movement transfer member for transmitting rotary motion of the operating shaft to a rotary shaft of the main contact, and a second movement transfer member for transmitting rotary motion of the operating shaft to a rotary shaft of the resistance contact, and a fifth movement transfer member for transmitting rotary motion of the operating shaft to a rotary shaft of the bypass contact.

23. The diverter switch according to claim 22, wherein said fifth movement transfer member comprises a Geneva mechanism.

24. The diverter switch according to claim 22, wherein the operating member is arranged to operate also the main vacuum switch, the resistance vacuum switch, whereby the operating member comprises a third movement transfer member for transforming rotary motion of the operating shaft into operating motion for the main vacuum switch, and a fourth movement transfer member for transforming rotary motion of the operating shaft into operating motion for the resistance vacuum switch.

25. The diverter switch according to claim 24, wherein said first movement transfer member, said second movement transfer member and said third movement transfer member are so arranged that rotation of the resistance contact occurs when the operating shaft has been rotated through a predetermined angle from a position when rotation of the main contact occurs, and rotation of the main contact occurs when the operating shaft has been rotated through a predetermined angle from a position when rotation of the bypass contact occurs.

26. The diverter switch according to claim 24, wherein said first movement transfer member, said second movement transfer member, said third movement transfer member, said fourth movement transfer member and said fifth movement transfer member are arranged such that operation of the bypass contact, the main contact, the resistance contact, the main vacuum switch and the resistance vacuum switch, respectively, occurs in a predetermined sequence and at predetermined angles of the movement of the operating shaft.

* * * * *